United States Patent [19]

Stumbar et al.

[11] 4,047,972

[45] Sept. 13, 1977

[54] METHOD FOR THERMALLY DE-SOOTING HEAT TRANSFER SURFACES

[75] Inventors: James P. Stumbar, Middletown Township, Allegheny County; Daniel E. Carl, Media; Suh Y. Lee, Monroeville, all of Pa.

[73] Assignee: Westinghouse Electric Corporation, Pittsburgh, Pa.

[21] Appl. No.: 726,038

[22] Filed: Sept. 23, 1976

[51] Int. Cl.[2] ..... C03C 23/00; B08B 7/00

[52] U.S. Cl. ..... 134/2; 134/19; 134/20; 134/21; 165/95; 208/48 R

[58] Field of Search ..... 134/2, 19, 20, 21, 37, 134/39; 165/5, 95; 208/48 R; 122/7 R

[56] References Cited

U.S. PATENT DOCUMENTS

| | | | |
|---|---|---|---|
| 3,060,064 | 10/1962 | Zingg | 134/2 |
| 3,850,741 | 11/1974 | Callahan et al. | 134/20 |

FOREIGN PATENT DOCUMENTS

| | | | |
|---|---|---|---|
| 1,380,465 | 1/1975 | United Kingdom | 134/19 |

*Primary Examiner*—Robert L. Lindsay, Jr.
*Assistant Examiner*—George C. Yeung
*Attorney, Agent, or Firm*—F. J. Baehr, Jr.

[57] ABSTRACT

Utilizing a CO monitor to control thermal de-sooting of a heat exchanger in order to prevent run-away reactions.

6 Claims, 2 Drawing Figures

METHOD FOR THERMALLY DE-SOOTING HEAT TRANSFER SURFACES

BACKGROUND OF THE INVENTION

This invention relates to a method for thermally de-sooting a heat exchanger and more particularly to such a method wherein a CO monitor is utilized to prevent run-away reactions.

Gas turbines burning fuel oil leave carbonaceous deposits on relatively cold heat transfer surfaces of boilers and waste heat boilers utilized in combined cycle energy systems. These deposits have deleterious affects on the performance of the waste heat boiler and if the buildup of carbonaceous materials becomes excessive fires can erupt and damage or destroy the heat exchangers.

Currently such deposits are removed by soot blowing techniques, however the utilization of finned tubes and closely packed tubes limits the effectiveness of such techniques.

SUMMARY OF THE INVENTION

In general, a method for removing carbonaceous deposits, which form on the outside of heat exchanger tubes disposed to extract heat from hot exhaust gases in a fossil fuel energy system, when made in accordance with this invention, comprises the steps of shutting down the system, draining the heat exchanger, blanketing the inside of the heat exchanger tubes with an inert gas and starting up the energy system and stabilizing its operation at a minimum temperature. The method further comprises monitoring the CO level of the effluent hot gases leaving the heat exchanger and increasing the inlet temperature of the influent hot exhaust gases entering the heat exchanger incrementally until the CO level of the effluent gases leaving the heat exchanger is within a predetermined range. The method further comprises the step of maintaining the temperature of the influent gases at a level which results in a CO level in the hot effluent gases flowing from the heat exchanger not exceeding a predetermined level, whereby the carbonaceous deposits are oxidized and removed from the outer surface of the heat exchanger without igniting the carbonaceous deposits and thereby preventing a run-away reaction, which would damage the heat exchanger.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENTS

Figure 1:
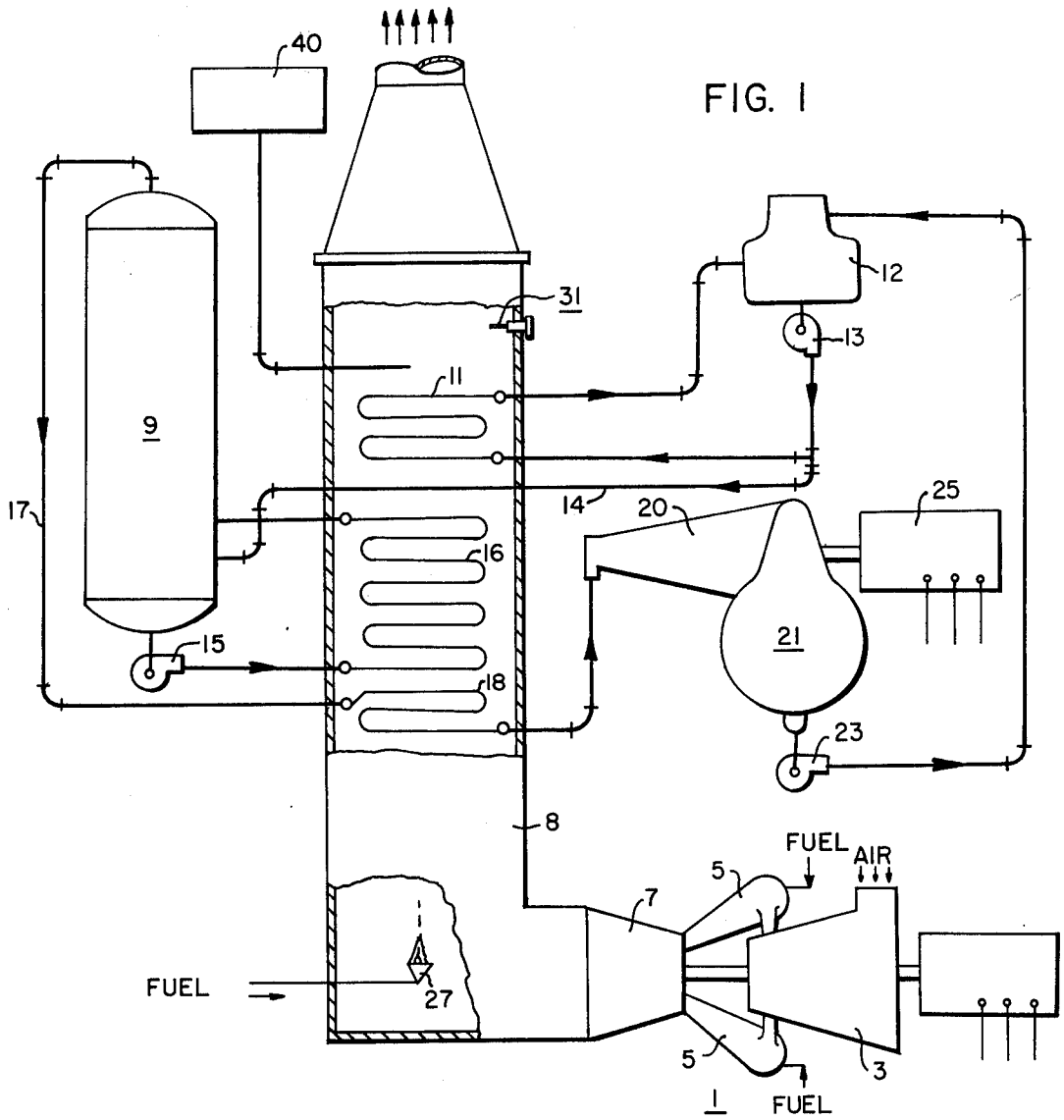
FIG. 1 is a schematic drawing of a combined cycle power plant having a heat recovery boiler in which carbonaceous deposits are removed in accordance with the method described in this invention.

Referring now to the drawings in detail, FIG. 1 diagrammatically shows a waste heat recovery system for recovering waste heat from the exhaust of a gas turbine 1 wherein air enters a compressor 3, is compressed and the pressurized air flows to a plurality of combustion chambers or combustors 5, wherein the air is mixed with a fuel such as natural gas or fuel oil, is ignited, and is burned in order to raise the temperature of the mixture. The high temperature mixture, or motive fluid, is then expanded in a gas turbine unit 7 to produce rotating mechanical energy. The exhaust gases leaving the gas turbine unit 7 still contains a large quantity of heat energy, which if exhausted to the atmosphere would be wasted. The other equipment shown in FIG. 1 is the heat recovery steam generator portion of the system and comprises an exhaust duct 8, a vertically oriented steam drum 9, a low pressure cooperator heat exchanger portion 11 disposed in the exhaust duct 8, a deaerating heat exchanger or deaerator 12 and a circulating pump 13. Feed-water entering the deaerator 12 is circulated through the low pressure evaporator 11 and returned to the deaerator 12 which heats the feedwater while maintaining the temperature of the low pressure evaporator above the dew point of the exhaust gases. A portion of the discharge from the circulating pump 13 is fed to the steam drum 9 via a conduit 14 disposed therebetween.

A second circulating pump 15 takes its suction from the steam drum 9 and circulates saturated water through a primary evaporator heat exchanger 16 disposed in the exhaust duct 8 upstream of the low pressure evaporator 11. Saturated steam produced in the primary evaporator 16 returns to the drum 9 where moisture contained therein is removed and the dry saturated steam then flows via a conduit 17 to another heat exchanger portion or superheater 18 disposed in the exhaust duct 8 upstream of the primary evaporator 16. Superheated steam produced in the superheater 18 then flows to a steam turbine 20 and the exhaust steam from the steam turbine 20 is condensed in a condenser 21. A condensate pump 23 returns the condensate to the deaerator thus forming a close cycle. FIG. 1 also shows a generator 25 coupled to each turbine for changing the rotating mechanical energy to electrical energy, however, the turbines may be coupled to a single generator by providing gearing or other connecting means therebetween.

The gas turbine 7 has an open cycle, that is, the motive fluid is not recirculated therethrough. An afterburner 27 is shown and provides additional heat for generating steam and controlling the temperature of the steam leaving the superheater 18. However, the use of an afterburner 27 is optional and other means may be provided for controlling the temperature of the steam leaving the superheater 18.

As shown in FIG. 1 the superheater 18, the main evaporator 16, the low pressure evaporator 11 form a heat exchanger which is disposed in the exhaust duct 8 and during normal operation of the system carbonaceous deposits from the fuel deposit on the surfaces of this heat exchanger, the coldest portion thereof normally collecting the heaviest deposits. Even though gas turbines operate with large amounts of excess air, there are certain amounts of unburned carbonaceous material that pass through the turbine and deposit on the relatively cold tubes of the heat exchanger. While these deposits are mostly carbon they contain other elements depending on the fuel and the operating condition and the composition and quantity of the deposits vary within a single boiler as the tubes vary appreciably in temperature from the low pressure evaporator to the superheater 18.

The amount or quantity of deposits may be determined by visual inspection of the heat exchanger, through experience when utilizing a specific fuel under normal conditions, from a drop in performance of the heat exchanger, from an increase in gas side pressure drop, or by installing a deposit indicating stick 31 downstream of the coldest portion of the heat exchanger, the low pressure evaporator 11.

Figure 2:
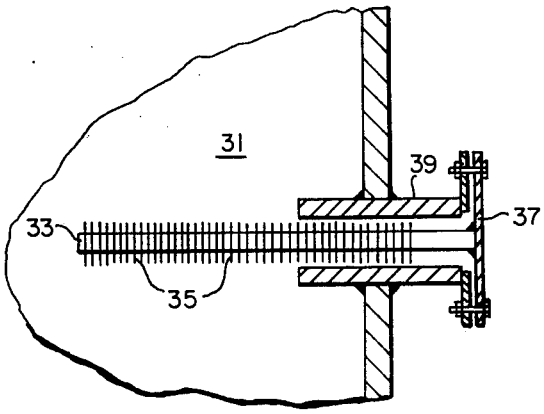
FIG. 2 is a partial sectional view showing a deposit indicator stick utilized in this invention.

As shown in FIG. 2 the deposit indicating stick 31 comprises a section of heat exchanger tube 33 similar to the low pressure evaporator tubes and contains a plurality of fins 35. The fins 35 are removed from one end of the deposit indicating stick 31 and that end is welded to a blind flange 37. A flanged nozzle 39 extends through the wall of the waste heat boiler and is welded thereto. The deposit indicating stick 31 extends through the nozzle 39 and into the flow path of the exhaust gases as they leave the low pressure evaporator portion 11 of the heat exchanger. Thus, the deposit indicating stick 31 is disposed adjacent the coldest portion of the heat exchanger and is subjected to the coldest exhaust gases. The deposits which collect on the deposit indicating stick 31 will be similar to those collected on the low pressure evaporator heat exchanger 11 tubes. So by visually inspecting the deposit indicating stick 31 an indication of the condition of the low pressure evaporator heat exchanger tubes can be ascertained since the low pressure evaporator portion 11 of the heat exchanger is the coldest portion of the heat exchanger during normal operation it will collect the greatest amount of carbonaceous deposits.

The method for removing these carbonaceous deposits from the tubes forming the heat exchanger, which receives heat from burning fossil fuel, when performed in accordance with this invention, comprises the following steps:

Shutting down the system and draining the water from the heat exchanger.

When the heat exchanger is drained nitrogen or some other inert gas is fed into the heat exchanger blanketing the inside surfaces of the heat exchanger to prevent corrosion thereof.

The energy system is then started up, in the embodiment shown herein, the gas turbine is started and brought up to speed and stabilized with the maximum air flow and minimum exhaust temperature.

A continuous monitoring device 40 is put into operation to continually monitor the level of carbon monoxide, CO, in the effluent exhaust gases as they leave the low pressure evaporator portion 11 of the heat exchanger right before entering the stack, after which they are exhausted to the atmosphere. A CO monitoring device capable of producing continuous indications of the CO level or relatively close periodic indications of the CO level in the range of 0 to 2,500 parts per million (ppm) are preferred.

The temperature of the exhaust gases from the gas turbine 7 is increased gradually until the CO level of the effluent gases leaving the low pressure evaporator portion 11 of the heat exchanger is in the range of 750 to 1,000 parts per million. It is felt that this range is reasonably safe for a relatively high grade of fuel oil and not extremely heavy carbonaceous deposits, the exact range will vary for each individual application.

When utilizing this method for the first time the inlet temperature to the heat exchanger should be increased in small incremental steps allowing time for the CO level to stabilize itself. If the CO level continues to increase at a rapid rate without increasing the inlet temperature, the fuel system should be shut off as this rapid increase in CO level is an indication that a run-away reaction is beginning and if not recognized before the reaction rate becomes too rapid, the carbonaceous deposits will ignite and may cause severe damage or destroy the heat exchanger. By shutting off the fuel the inlet temperature drops rapidly quenching the reaction rate and preventing a run-away reaction. However, once the reaction has run away and the carbonaceous deposits have become ignited shutting off the fuel will not stop the reaction. By monitoring the CO level and raising the inlet temperatures small incremental amounts sufficient indication is provided to prevent run-away reactions.

The method further comprises the step of setting a maximum CO level, or predetermining a CO level at which to shut the fuel off. This is another way to prevent run-away reactions. Again the design of the heat exchanger and the fuel utilized make it impractical to set one value as the maximum allowable CO level. It is safer to start with a reasonably low safe level and raise it as experience is gained on that particular heat exchanger and fuel. Changes in the type of fuel can appreciably alter the amount and type of carbonaceous deposits collected on the heat exchanger tubes. In some designs of waste heat boilers utilized in the combined cycle system in which high grade fuel oil is burned in a gas turbine 1,000 parts per million of CO is a safe upper limit. In other waste heat boiler designs 1,000 parts per million of CO may be unsafe or too conversative because heat exchanger outside tube surface areas are a prime controlling variable. Higher CO limits increase the speed at which the deposits are removed and operate closer to the temperature at which a run away reaction begins.

If the inlet temperature to the heat exchanger is maintained at a constant level, the amount of CO in the effluent gases from the heat exchanger will decrease, when this begins to happen the inlet temperature should be increased an incremental amount. An 18° F rise in inlet temperature may cause a rise in CO level of approximately 850 parts per million. Thus, knowing the CO level provides a much more accurate indication of the thermal de-sooting operation than temperature indication. If the CO level continues to drop as the inlet temperature is increased, it is an indication that the major portion of the carbonaceous deposits have been oxidized and removed.

The deposit indicator stick 31 can also be inspected at intervals during the de-sooting process to determine the amount of carbonaceous deposits oxidized and removed. When the inspection reveals that the deposit indicator stick 31 has a sufficient amount of the deposits removed, the heat exchanger is generally in the same condition and the thermal de-sooting operation can be shut down.

Another way to determine that the thermal de-sooting operation is complete is to raise the inlet temperature in incremental amounts while maintaining the CO level within predetermined limits until a predetermined maximum inlet temperature is reached and maintaining this temperature until the CO level drops to approximately 150 to 200% of the normal operating CO level for the gas turbine. Once the thermal de-sooting operation is complete this system may be brought down and made ready for normal wet operation. As a history on a particular unit is built up while burning a specific fuel, the parameters of CO level of the hot effluent gases from the heat exchanger and inlet temperatures can be varied to provide a safe and rapid method for removing carbonaceous deposits from the outside of the tubes of the heat exchanger without risking the possibility of a run-away reaction, which may damage or destroy the heat exchanger.

What is claimed is:

1. A method for removing carbonaceous deposits which form on the outside of heat exchanger tubes disposed to extract heat from hot exhaust gases from a fossil fuel energy system, said method of removing carbonaceous deposits comprising the steps of:

shutting down the system;

draining water from the heat exchanger tubes;

blanketing the inside of the heat exchanger tubes with an inert gas;

starting up the energy system and stabilizing its operation at a minimum temperature;

maintaining a predetermined CO level of the effluent hot exhaust gases leaving the heat exchangers;

increasing the inlet temperature of the influent hot exhaust gases entering the heat exchanger until the CO level of the effluent gases leaving the heat exchanger is within a predetermined range, maintaining the temperature of the influent hot exhaust gases at a level which results in a CO level in the effluent hot exhaust gases leaving the heat exchanger not to exceed a predetermined limit;

said predetermined limit of CO being sufficient to oxidize and remove the carbonaceous deposits from the outer surface of the heat exchanger without igniting the carbonaceous deposits and thereby preventing a run-away reaction which would damage the heat exchanger.

2. The method of removing carbonaceous deposits as set forth in claim 1 and further comprising the step of shutting down the system when the CO level in the effluent hot exhaust gases from the heat exchanger cannot be maintained at a predetermined level while increasing the temperature of the influent hot exhaust gases to the heat exchanger.

3. The method of removing carbonaceous deposits as set forth in claim 1 and further comprising the step of shutting down the system when the temperature of the influent hot exhaust gases to the heat exchanger reaches a predetermined level.

4. The method of removing carbonaceous deposits as set forth in claim 1 and further comprising the steps of:

installing a deposit indicator stick in the gas passages downstream of the heat exchanger;

inspecting the deposit indicator stick to determine when to begin removing carbonaceous deposits; and, inspecting the deposit indicator stick during the removal of carbonaceous deposits to determine when sufficient amounts of the deposits have been removed.

5. The method of removing carbonaceous deposits as set forth in claim 1 wherein the step of monitoring the CO level of the effluent hot gases from the heat exchanger includes responding to a CO level in excess of a predetermined level to shut down the system in order to prevent a run away reaction.

6. The method of removing carbonaceous deposits as set forth in claim 1 wherein the step of increasing the inlet temperature of the influent hot exhaust gases comprises increasing the inlet temperature in small incremental amounts and allowing the CO level to begin to decrease prior to increasing the temperature the next incremental amount.

* * * * *